US009745033B1

(12) United States Patent
Maffett

(10) Patent No.: US 9,745,033 B1
(45) Date of Patent: Aug. 29, 2017

(54) BOAT STORAGE STACKER WITH ROTATABLE AND OFFSET MAST

(71) Applicant: Brian Maffett, Cookeville, TN (US)

(72) Inventor: Brian Maffett, Cookeville, TN (US)

( * ) Notice: Subject to any disclaimer, the term of this patent is extended or adjusted under 35 U.S.C. 154(b) by 371 days.

(21) Appl. No.: 14/217,190

(22) Filed: Mar. 17, 2014

Related U.S. Application Data

(60) Provisional application No. 61/800,675, filed on Mar. 15, 2013.

(51) Int. Cl.
*B63C 3/12* (2006.01)
*B63C 15/00* (2006.01)

(52) U.S. Cl.
CPC ..... *B63C 3/12* (2013.01); *B63C 15/00* (2013.01)

(58) Field of Classification Search
CPC combination set(s) only.
See application file for complete search history.

(56) References Cited

U.S. PATENT DOCUMENTS 3,786,942 A 1/1974 Dane, Jr.
4,190,031 A 2/1980 Sigwald et al.
4,523,887 A * 6/1985 Reiff ..... B66C 17/10 212/319
5,489,033 A 2/1996 Luebke
6,007,288 A 12/1999 Maffett et al.
6,162,003 A 12/2000 Gruner
7,112,007 B2 9/2006 Maffett et al.
7,367,747 B2 5/2008 Maffett et al.
2002/0176767 A1 11/2002 Gisselberg

FOREIGN PATENT DOCUMENTS

FR 2864518 A1 * 7/2005 ..... B63C 3/06
WO PCT/US2007/005540 9/2007

OTHER PUBLICATIONS

ACE_World_Stack_N_Stow.
Eccentrio_Stacker_Crane_1.
Louden_High_Rise_Boat_Stacker_System_Eccentrio_Stacker_Crane_3.
1995_REPORT_AH_CRANE_Oscar_Fournier_about_Lambs_Marine_Stacker_Crane.pdf.

* cited by examiner

*Primary Examiner* — Kyle Armstrong
(74) *Attorney, Agent, or Firm* — Bradley Arant Boult Cummings; Phillip E. Walker; Timothy L. Capria

(57) ABSTRACT

Disclosed herein is a watercraft storage stacker crane system that incorporates an offset mast.

20 Claims, 14 Drawing Sheets

BOAT STORAGE STACKER WITH ROTATABLE AND OFFSET MAST

This is a non-provisional patent application claiming priority to U.S. Provisional Patent Application Ser. No. 61/800,675 filed Mar. 15, 2013 and entitled "Boat Storage Stacker with Rotatable and Offset Mast".

This non-provisional patent application is filed by Brian Maffett, a citizen of the United States, residing at 231 East Broad Street, Suite 102, Cookeville, Tenn. 38501, for the invention of a "Boat Storage Stacker with Rotatable and Offset Mast."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present disclosure relates generally to a crane assembly for moving items into and out of storage. More particularly, the present disclosure relates generally to an improvement overhead traveling crane for transporting watercraft in and out of dry storage.

The dry storage of watercraft has become increasingly popular over the years. This dry dock storage typically includes a stacked or vertical arrangement of watercraft that is lifted from the water's surface and placed in a stacked arrangement. For example, U.S. Pat. Nos. 6,007,288; 7,112,007; 7,367,747; 5,489,033; 3,786,942; 4,190,031; 6,162,003; U.S. Publication No. 2002/0176767 and PCT No. US 2007/4005540 and similar art disclosed and referenced in those applications and publications discuss dry watercraft storage.

In the conventional art, the lifting apparatus for this dry watercraft storage is typically a cradle device or support device suspended by either ropes or cables. The ropes and cables are collected in drums positioned near bridge girders, or horizontal supports, which move the cradle within the storage facility. Alternately, the lifting apparatus for this dry watercraft storage can be a forked arm type device can be attached to a mast that extends down from a central location on those bridge armatures and supports the boat when transferred between storage and the water. This support extending vertically down has typically been a centrally located mast that is rotatable about a trolley or a turntable usually positioned on the bridge supports of the crane structure.

These existing cranes that have a central mast can be described as stacker cranes. They are typically balanced only in an unloaded condition. This is due to the fact that the heavy hoist and mast are centered on the turntable in the center of rotation of the turntable. The mast hangs in a vertically plumb position. In addition, the footprint of the turntable is typically small in diameter and does not accommodate a wide range of loads, or types of boats, and the varying center of gravities of those loads.

For many watercraft, when loaded onto these conventional carriage or fork type lifting devices, the watercraft's center of gravity will fall outside the rotation of the support structure, or outside of the center of gravity of the overall turntable mast and lifting structure. This puts a large eccentric momentum force on the rotational bearing. This results in an unbalanced and unstable system that requires high maintenance and experiences many system failure problems. Additionally, frequently when this conventional system is loaded, the mast is pulled excessively out of plumb.

Conventional logic has been to compensate for this shortcoming by over designing the lift system so that the crane and mast can strong arm the load. In this situation, the mast and crane are made excessively heavy and in turn are expensive.

These conventional systems also put strain on the bridge girders if the boats are of sufficient size to pull the center of gravity of the loaded conventional stacker crane outside the footprint of the bridge girders. This can put undue strain on the bridge girders. Or alternately, it can temporarily disengage the opposite end of the stacker crane system from the bridge girder and potentially overturn the whole assembly. Again, the conventional wisdom has been to over engineer the systems such that the mass and size of the conventional stacker crane assembly greatly compensates for this movement in center of gravity.

What is needed then is a new watercraft stacker crane system.

BRIEF SUMMARY OF THE INVENTION

Disclosed herein is a watercraft storage stacker crane system that incorporates an offset mast.

The rotating turntable of the current inventive system has a larger diameter that accommodates a greater positional range of load and the center of gravity of that load. In the current system, the rotating turntable is located above the trolley and is supported by the trolley from below with a thrust bearing. As such, the mast can generally not be pulled away, or broken free from, the upper bridge crane assembly. This is different from conventional cranes that use rotating bearings that can fail and allow the mast and load to break free from the upper crane assemblies since these rotating bearing are not typically designed to accommodate large thrust loads.

The offset of the current system takes place below the bottom of the bridge girders and has an increased length so as to accommodate a greater watercraft center of gravity offset. An advantage in the current system is the placement of the turntable above the bridge girders such that the larger turntable diameter overlaps and occupies at least some of the same footprint as the bridge girders, thereby reducing the crane system footprint.

In the current system, the hoist that operates the upward momentum of the cradle and is not aligned with the center of rotation. This hoist device uses idler pulleys to drop the cables over so as to be routed down through the mast to the carriage or forks positioned there. The current design repositions the hoist forward so that the entire center of gravity of the crane system is better positioned relative to the center of rotation. Additionally, this configuration positions the hoist assembly opposite that of a mast assembly, thereby allowing their weights to balance about the center of rotation.

Further, the current system has advantages over the prior art. These advantages include a stacker crane that is balanced while loaded as well as unloaded. This stacker crane can accommodate a wide range of boats with a wide range of center of gravity locations. It can be configured such that the center of gravity of the rotating system, which includes the watercraft, carriage, mast, upper and lower turntables, and the hoist is preferably always located within the support footprint of the rotating structure through a full 360 degrees of rotation. Additionally, the current stacker crane is configured such that when it is unloaded the center of gravity of the rotating system, which in this case is the carriage, mast, lower and upper turntables, and the hoist, is located within the support footprint of the rotating structure through a 360 degrees of rotation.

Additionally, the system is configured such that the footprint of the rotating structure is large enough to accommodate the center of gravities of the unloaded and loaded system but is of a size that is practical given the space constraints of typical dry storage facilities. It is typically the diameter of the rotating structure within the dry storage facilities that dictates the overall footprint of the crane system and the watercraft storage facility as a whole. Additionally, the system can minimize the momentum forces created, or developed, when moving loads at speeds, accelerations and decelerations. These forces will preferably be reduced, or conversely the speeds can be increased during operation, with the current center of gravity of the system being balanced about the center of motion of the inventive system.

Preferably this system locates the loaded center of gravity that includes the watercraft as close as possible to the center of motion, or rotation. This minimizes angular of velocity of the loaded system and therefore reduces angular momentum. This reduction in angular momentum improves the load stability and allows for high rotational speeds. It should be noted that generally a watercraft's center of gravity is typically located between 35-40 percent of the boat's length as measured from the stern of the boat. Therefore, a preferred optimal location for a center of rotation of a boat stacker crane with the least amount of angular momentum of a load would be a point between 30-40 percent of the length of the watercraft to be stored when loaded.

DETAILED DESCRIPTION OF THE INVENTION

Figure 1:
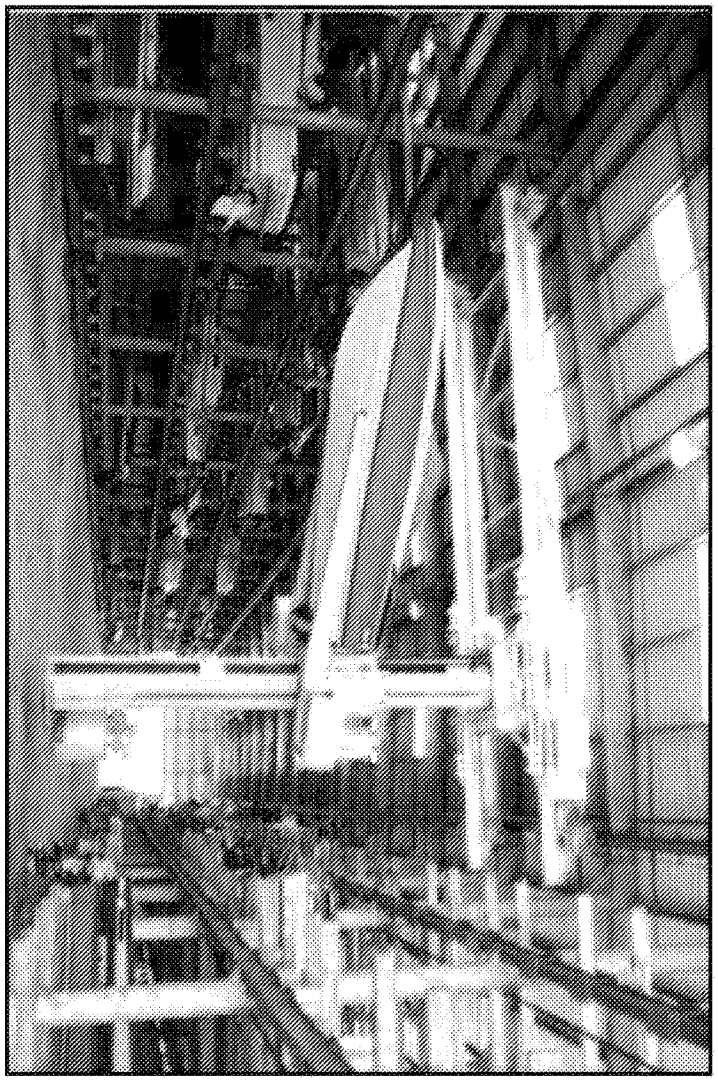
FIG. 1 (PRIOR ART)
FIG. 1 shows an example of prior art.
Figure 2:
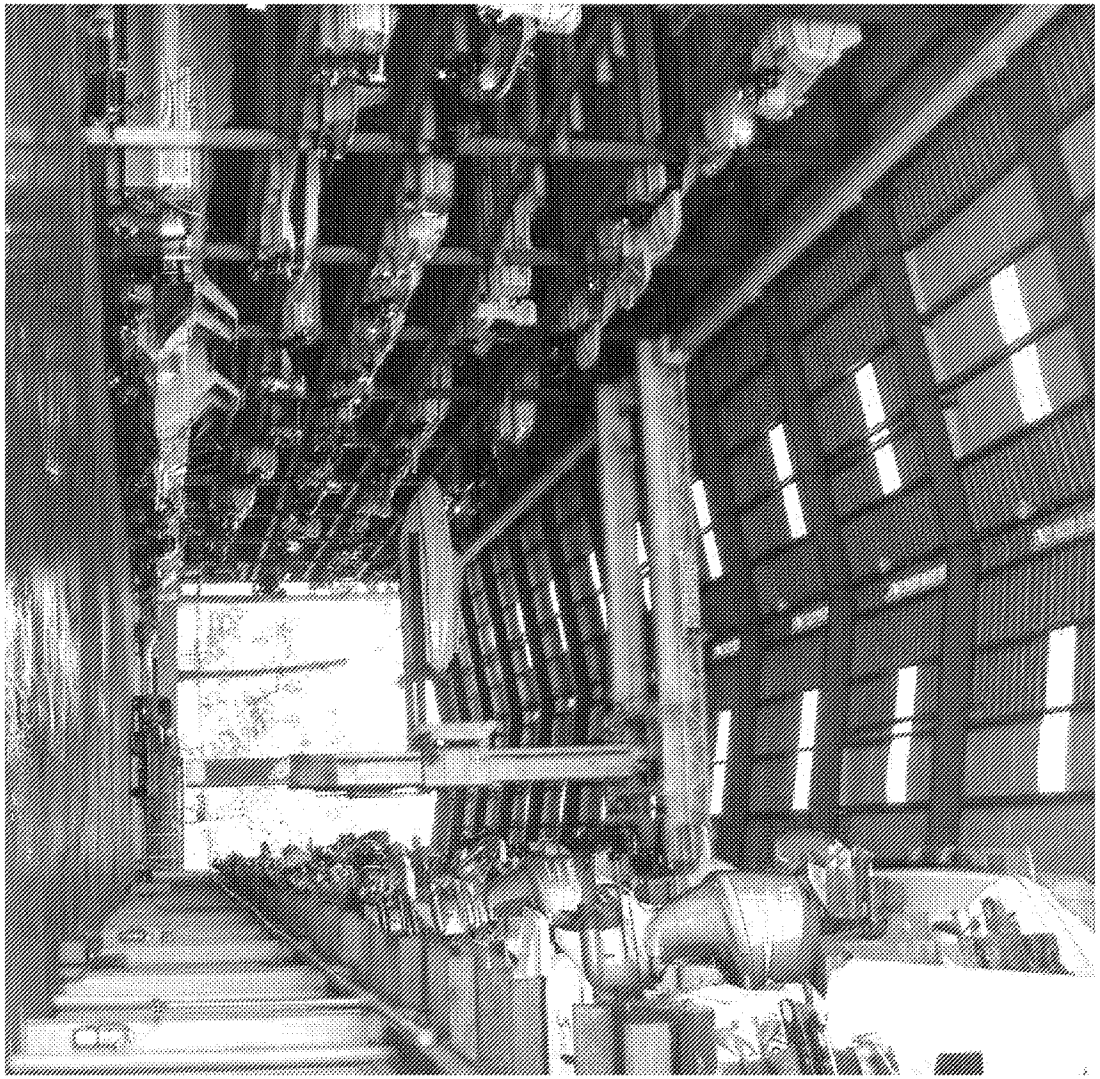
FIG. 2 (PRIOR ART)
FIG. 2 shows an example of prior art.
Figure 3:
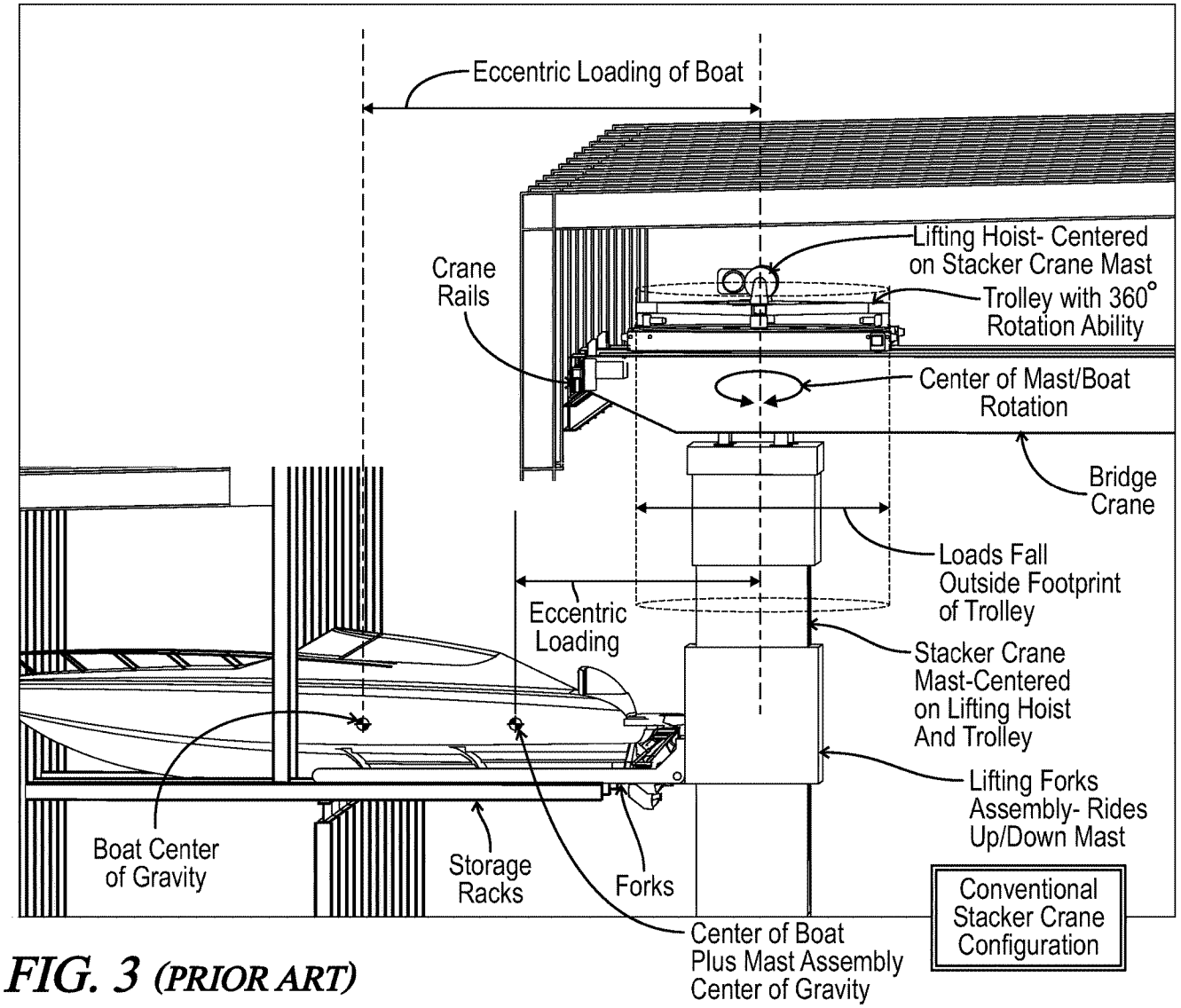
FIG. 3 (PRIOR ART)
FIG. 3 shows a prior art stacker crane with eccentric loading.
Figure 4:
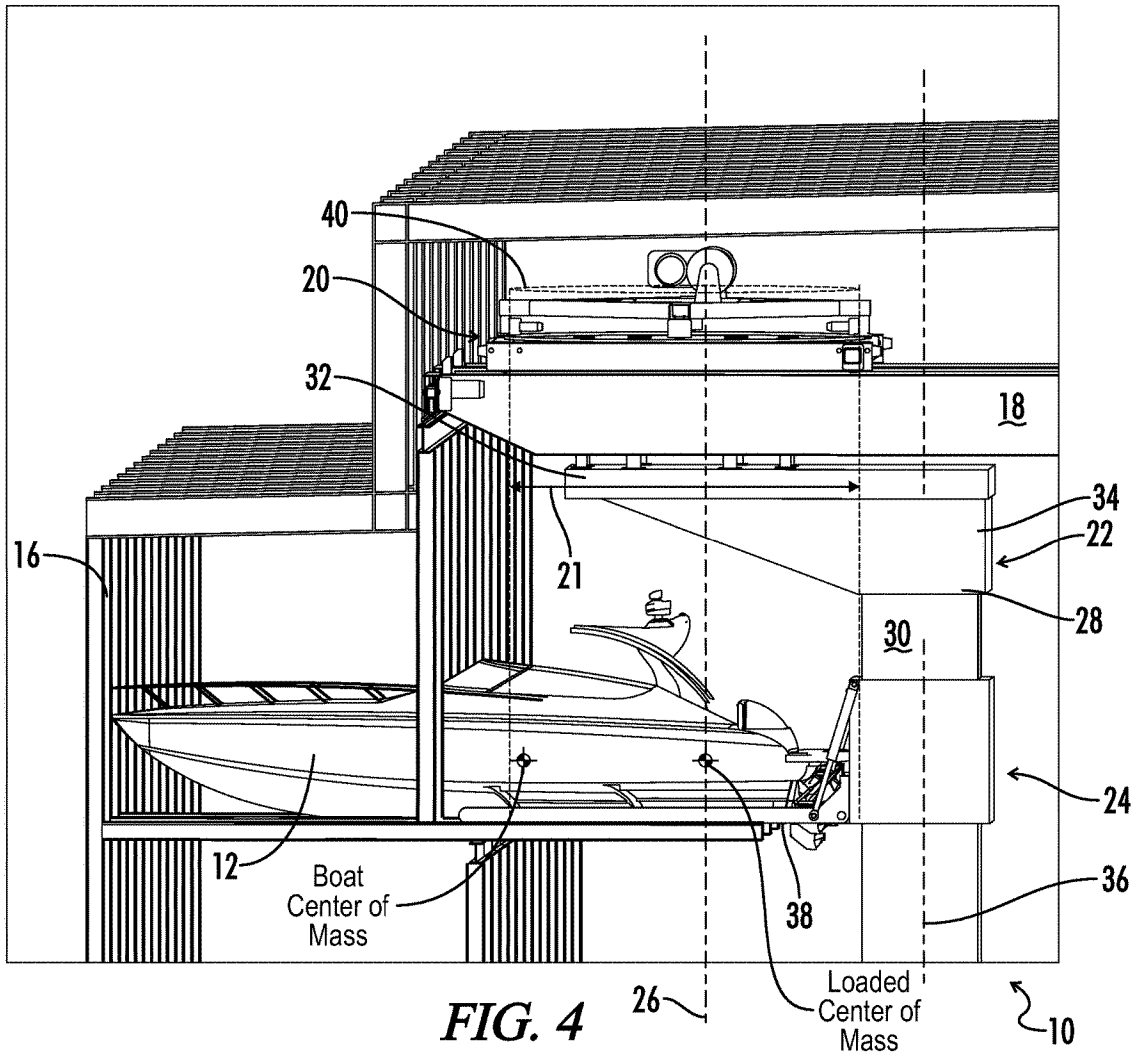
FIG. 4 shows a side perspective view of a loaded system made in accordance with the current disclosure.
Figure 5:
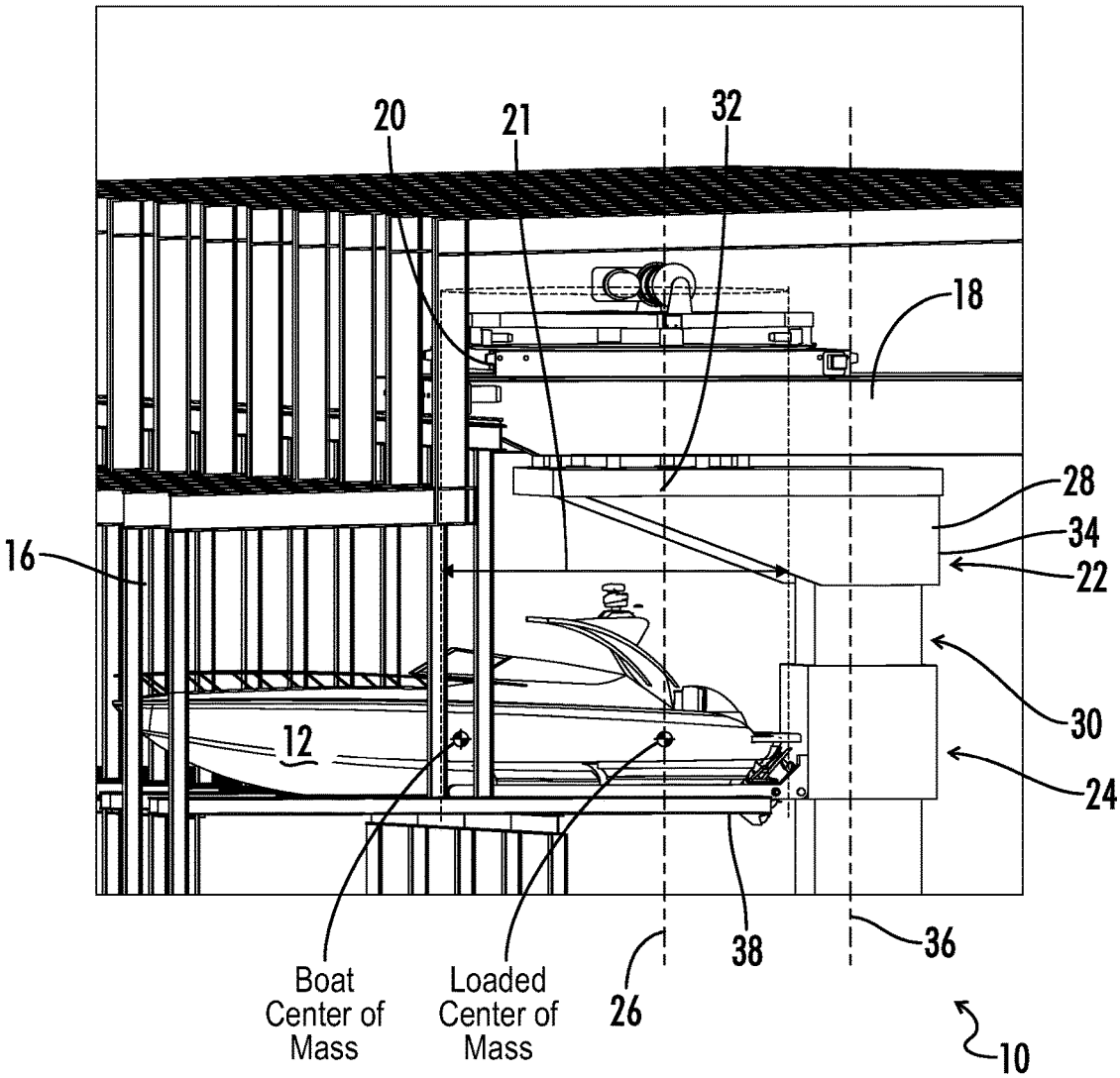
FIG. 5 shows another side perspective view of the system shown in FIG. 4.
Figure 6:
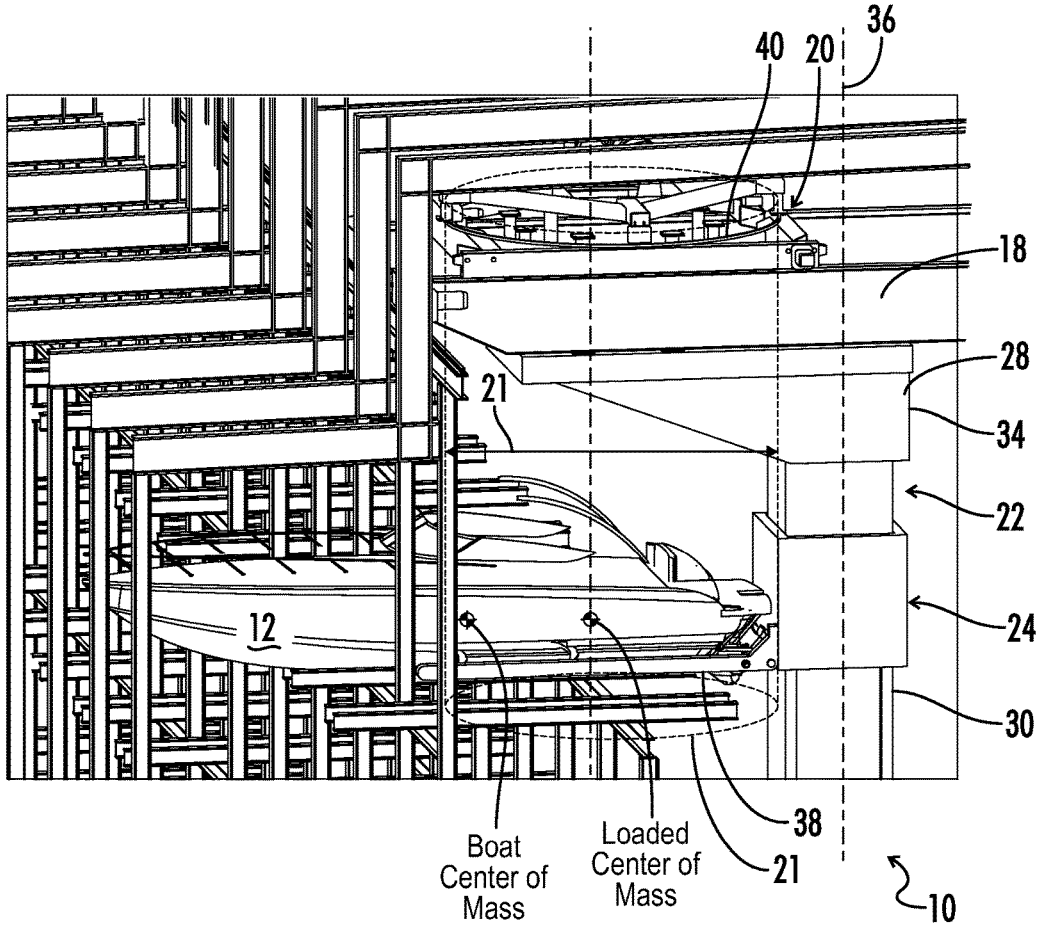
FIG. 6 shows a top side perspective view of the system shown in FIGS. 4-5.
Figure 7:
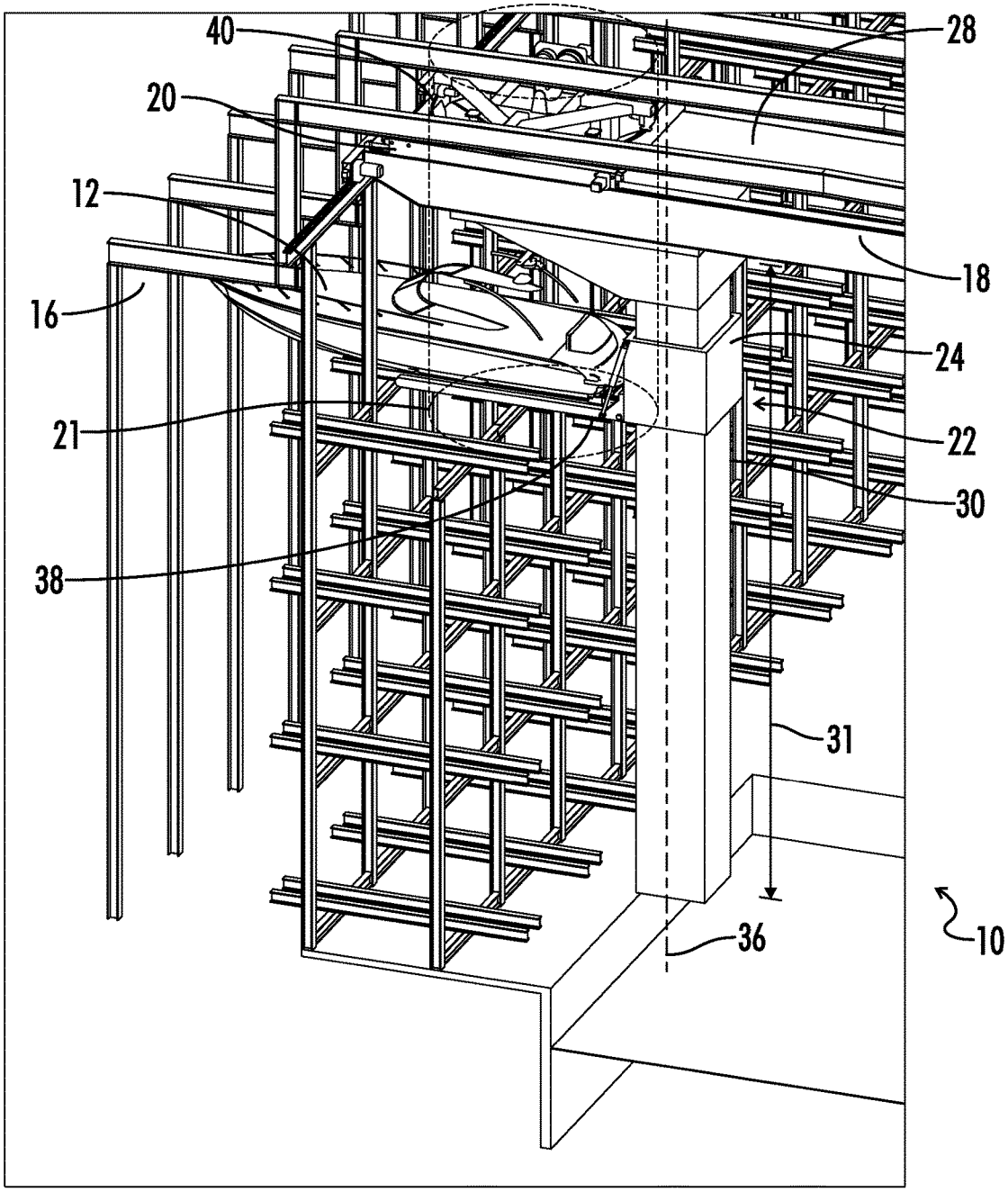
FIG. 7 shows a top side perspective view of the system shown in FIGS. 4-6.
Figure 8:
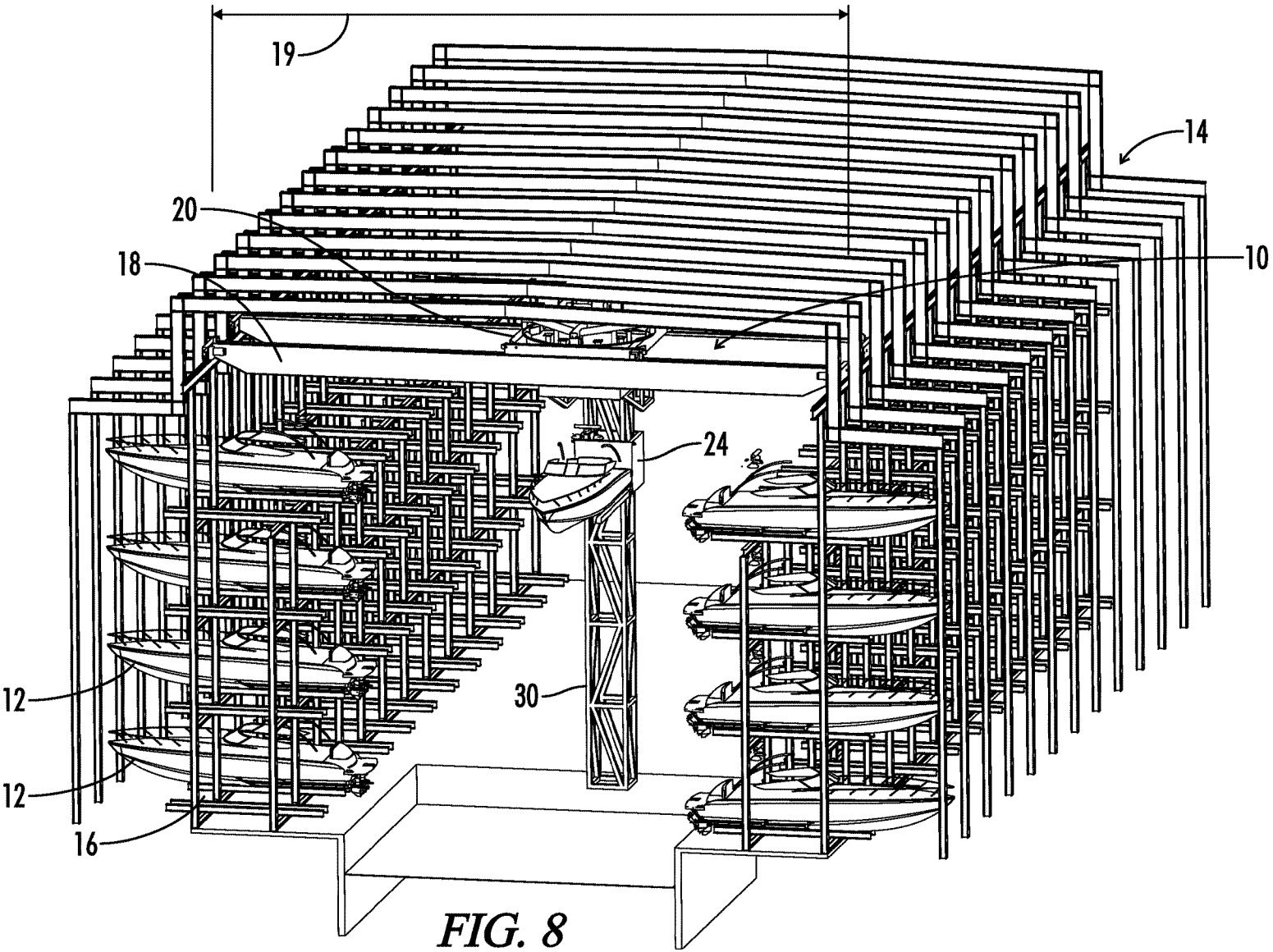
FIG. 8 shows a view of a system made in accordance with the current disclosure in a water craft storage facility.
Figure 9:
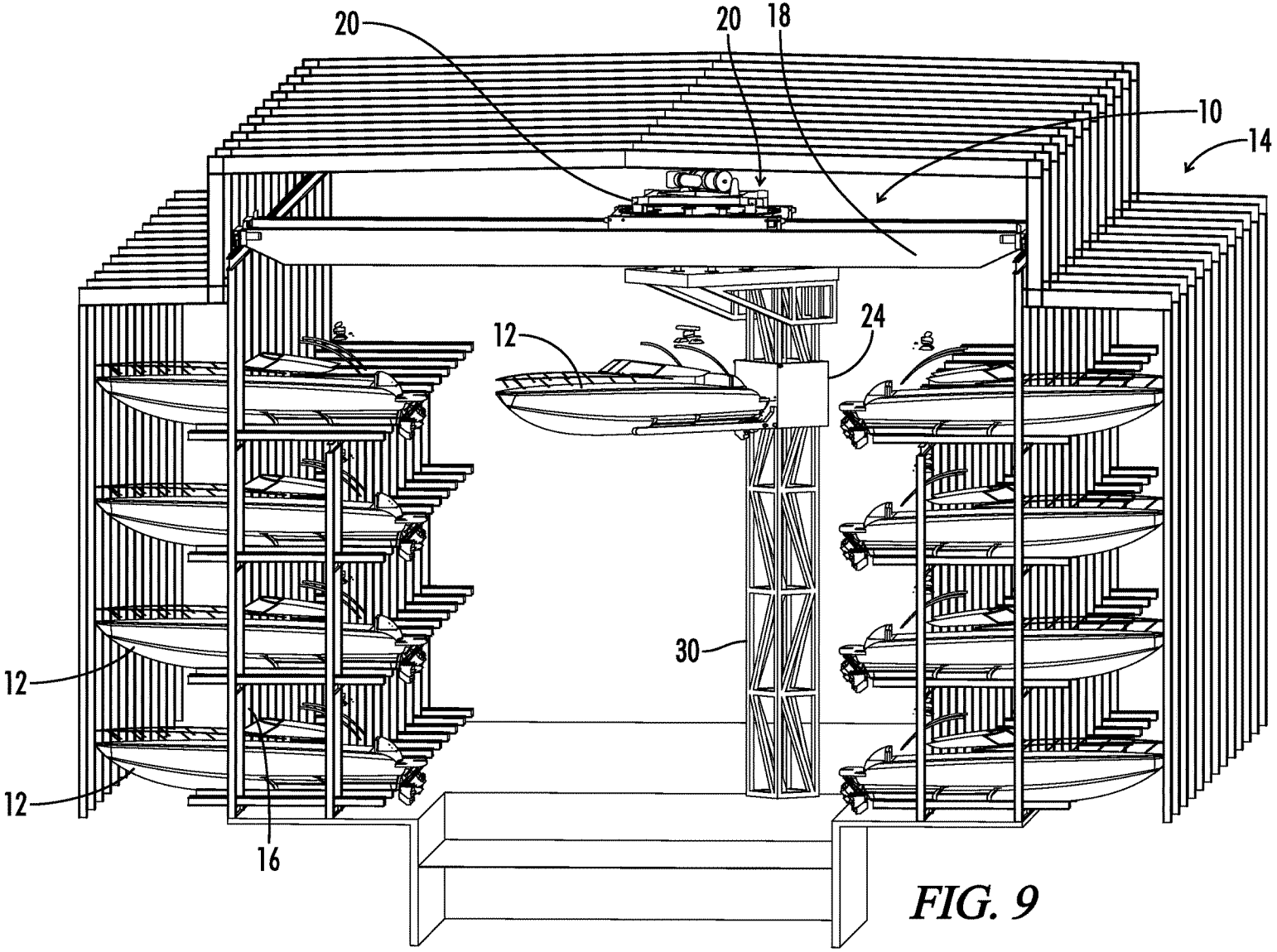
FIG. 9 is an alternate view of the system and facility shown in FIG. 8.
Figure 10:
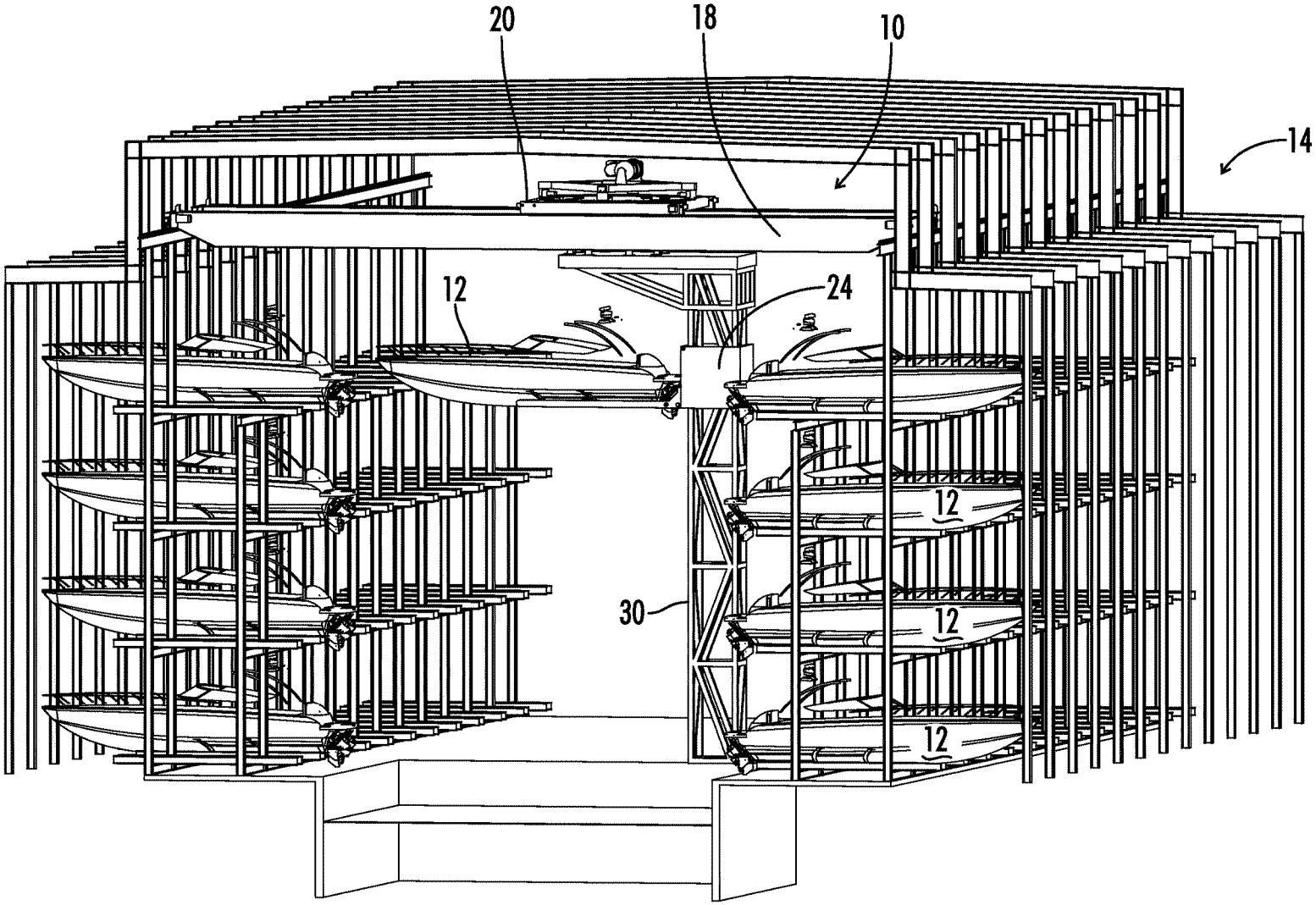
FIG. 10 is an alternate view of the system and facility shown in FIGS. 8 and 9.
Figure 11:
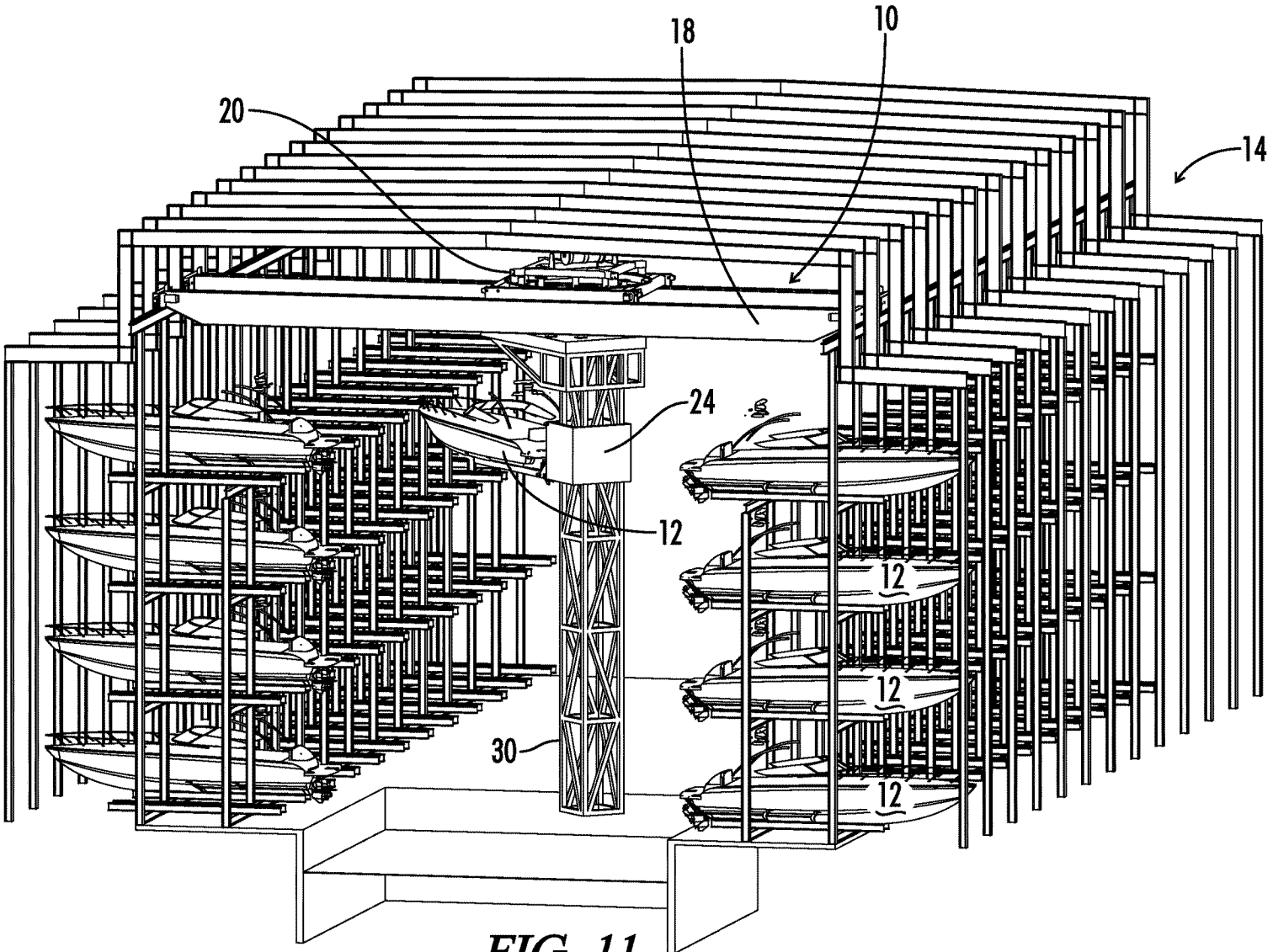
FIG. 11 is an alternate view of the system and facility shown in FIGS. 8-10.
Figure 12:
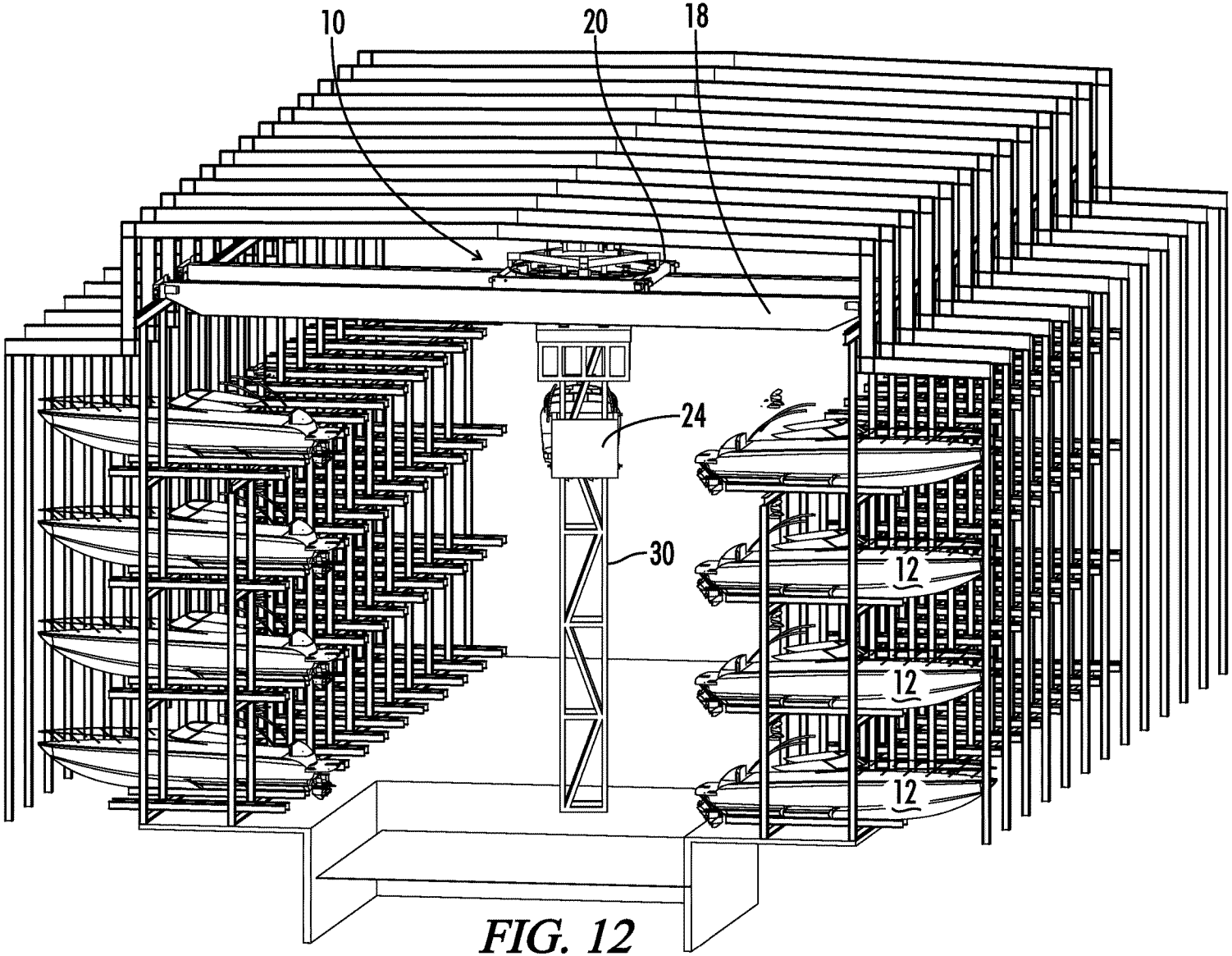
FIG. 12 is an alternate view of the system and facility shown in FIGS. 8-11.
Figure 13:
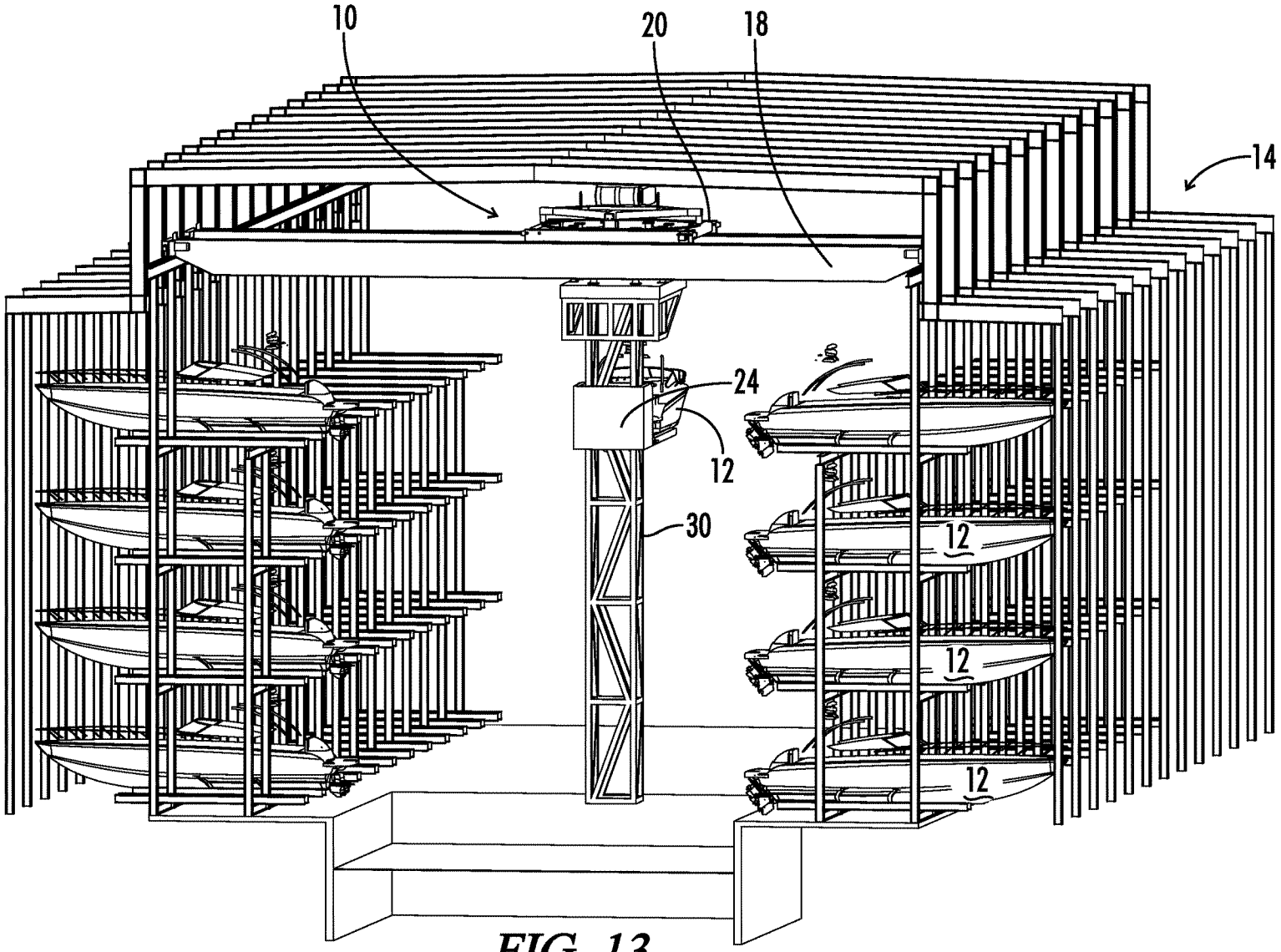
FIG. 13 is an alternate view of the system and facility shown in FIGS. 8-12.
Figure 14:
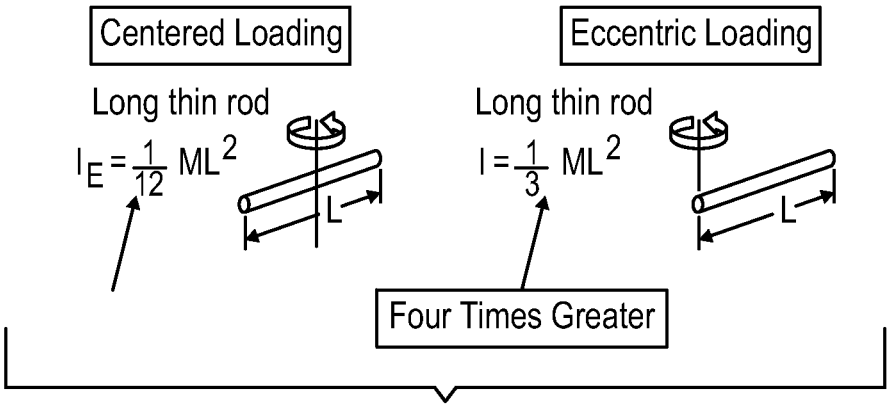
FIG. 14 is a schematic showing the difference in the moment of inertia for center loading beams versus eccentric loaded beams.

Referring generally now to FIGS. 1-3 prior art stacker cranes have included center of gravities that fall outside the footprint of the turning device. This is especially true when the stacker cranes are loaded with a water craft as shown in FIGS. 1 and 2. In these images, as explained graphically in FIG. 3, the loading of the water craft, and its center of gravity, takes the overall center of gravity of the water craft and the conventional stacker crane assembly outside the footprint of the rotating device. As previously mentioned this puts a large amount of strain on the rotating device, mast, and overall stacker crane assembly. This strain either causes premature failure in this stacker crane assembly or mandates large expensive devices that are over engineered in order to counteract this center of gravity phenomenon that occurs outside the turning device footprint.

Referring now generally to FIGS. 4-13, a stacker crane is shown and generally designated by the numeral 10. The stacker crane 10 is for moving of a watercraft 12, which can be described as a boat 12, that includes a water craft mass. The stacker crane 12 is used in a water craft storage facility 14 having a storage modules 16. The stacker crane 10 comprises a bridge 18, a trolley 20, a mast device 22, and a lifting assembly 24.

The bridge 18 is operatively suspended in the water craft storage facility 14 and includes a length 19. The trolley 20 is connected to the bridge 18 and is positioned to translate along the length 19 of the bridge 18. The trolley 20 includes a trolley center of rotation 26, a trolley mass, and a trolley footprint.

The mast device 22 is connected to the bridge 18 and the trolley 20. The mast device includes a top 28, a stanchion 30, and a mast device mass. The top includes a first end 32 and a second end 34 wherein the first end 32 is substantially vertically aligned with the trolley center of rotation 26 while the second end 34 is attached to the stanchion 30. The stanchion 30 includes a length 31 having an axis 36 that is substantially vertically offset from the trolley center of rotation 26.

The lifting assembly 24 is attached to the stanchion 30 and includes lifting armatures 38 shaped to accept the water craft 12. The lifting assembly 24 further includes a lift assembly mass and is further positioned to translate vertically along the length 31 of the stanchion 30.

In one embodiment, the trolley 20 further includes a rotating turntable 40 positioned to establish the trolley's center of rotation 26. The rotating turntable 40 is positioned opposite the connection of the trolley 20 to the bridge 18. The trolley 20, with the aid of the rotating turntable 40, can rotate at least 180 degrees about the trolley's center of rotation 26. In one embodiment, the trolley 20 can rotate 360 degrees about the trolley's center of rotation 26. Further, the rotating turntable 40 can be supported by the remainder of the trolley 20 by a bearing type arrangement, such as a thrust bearing. Since this bearing is positioned above the remainder of the trolley 20 and the bridge 18, any failure in the bearing when transporting the load, such as the water craft 12, does not allow the mast device 22 to breaking free from the bridge 18 or dropping the mast device 22 and the water craft 12.

In an embodiment, the axis 36 of the stanchions 30 is positioned outside the trolley footprint a distance approximately equal to the length of the top 28 of the mast device 22. This positioning facilitates the location of the loaded stacker crane system to be within the trolley footprint.

In an embodiment, the trolley mass and the device mass combine to establish an unloaded center of rotation wherein the unloaded center of rotation is within the trolley footprint. Additionally, when a water craft 12 is loaded onto the lifting armatures 38 the water craft mass, the trolley mass, and the mast device mass combine to establish a loaded center of rotation or a loaded center of gravity, wherein the loaded center of rotation is also within the trolley footprint 21. In an embodiment, the loaded center of rotation is approximately vertically aligned with the trolley's center of rotation 26. Alternately described, the trolley mass and the mast device mass combine to establish an unloaded center of mass wherein the unloaded center of mass is within the trolley footprint 21. Additionally, when a water craft 12 is loaded onto the lifting arms 38, the water craft mass, the trolley mass and the mast device mass combine to establish a loaded center of mass and the loaded center of mass is within the trolley footprint 21.

Again, this loading and arrangement of the loaded center of mass facilitates a substantial alignment of the trolley center of rotation 26 with the loaded center of mass, or loaded center of gravity. This approximate alignment greatly reduces the stress and strain on the stacker crane 10 when loaded with a water craft 12. This reduced strain allows a leaner stacker crane 10 device such that the inventive stacker crane does not require the amount of redundancies or materials used in conventional stacker cranes. This greatly reduces the weight, manufacturing time, strain on the water craft facility 14, and the overall cost of the inventive stacker crane 10.

Thus, although there have been described particular embodiments of the present invention of a new and useful Boat Storage Stacker with Rotatable and Offset Mast, it is not intended that such references be construed as limitations upon the scope of this disclosure.

What is claimed is:

1. A stacker crane for movement of watercraft having a watercraft mass, the stacker crane used in a watercraft storage facility having storage modules, the stacker crane comprising:

a bridge operatively suspended in the watercraft storage facility, the bridge including a length;

a trolley connected to the bridge, the trolley positioned to translate along the length of the bridge, the trolley including a trolley center of rotation, a trolley mass, and a trolley footprint;

a mast device operatively connected to the bridge and connected to the trolley, the mast device including a top, a stanchion and a mast device mass, the top having a first end and a second end, the first end substantially positioned along an axis defined by the trolley center of rotation, the second end attached to the stanchion, the stanchion including a length and having a central axis outside the trolley footprint by a distance approximately equal to a length of the top of the mast device; and a lift assembly attached to the stanchion, the lift assembly including lifting armatures shaped to accept the watercraft and a lift assembly mass, the lift assembly positioned to translate vertically along the length of the stanchion.

2. The stacker crane of claim 1 the trolley rotates at least 180 degrees about the trolley center of rotation.

3. The stacker crane of claim 2 the trolley rotates 360 degrees about the trolley center of rotation.

4. The stacker crane of claim 1 wherein the stanchion axis is positioned outside the trolley footprint.

5. The stacker crane of claim 1 wherein the trolley mass and the mast device mass combined to establish an unloaded center of rotation and the unloaded center of rotation is within the trolley footprint.

6. The stacker crane of claim 5 wherein, when a watercraft is loaded onto the lifting armatures, the watercraft mass, the trolley mass, and the mast device mass combined to establish a loaded center of mass and the loaded center of mass is within the trolley footprint.

7. The stacker crane of claim 1 wherein, when a watercraft is loaded onto the lifting armatures, the watercraft mass, the trolley mass, and the mast device mass combined to establish a loaded center of rotation and the loaded center of rotation is within the trolley footprint.

8. The stacker crane of claim 7 wherein the loaded center of rotation is approximately along the axis defined by the trolley center of rotation.

9. The stacker crane of claim 1 wherein the stacker assembly is shaped to load the watercraft into one of the storage modules.

10. The stacker crane of claim 1 wherein the trolley mass and the mast device mass combined to establish an unloaded center of mass and the unloaded center of mass is within the trolley footprint.

11. The stacker crane of claim 1 the trolley further including a rotating turntable positioned to establish the trolley center of rotation.

12. The stacker crane of claim 11 wherein the rotating turntable is positioned opposite the connection of the trolley to the bridge.

13. The stacker crane of claim 1, wherein the trolley is configured to control horizontal and vertical movement of the stanchion.

14. The stacker crane of claim 1, wherein the stanchion is in a fixed horizontal relationship with the axis of the trolley center of rotation.

15. A stacker crane for movement of watercraft having a watercraft mass and a watercraft center of gravity, the stacker crane used in a watercraft storage facility having storage modules, the stacker crane comprising:

a bridge operatively suspended in the watercraft storage facility, the bridge including a length;

a trolley connected to the bridge, the trolley positioned to translate along the length of the bridge, the trolley including a trolley mass, a trolley center of gravity, a trolley footprint and a rotating turntable positioned to establish a trolley center of rotation;

a mast device connected to the bridge and operatively connected to the trolley, the mast device including a top, a stanchion, a mast device mass and a mass device center of gravity, the top having a first end and a second end, the first end substantially positioned along an axis defined by the trolley center of rotation, the second end attached to the stanchion, the stanchion including a length and having a central axis substantially outside the trolley footprint by a distance approximately equal to the length of the top of the mast device; and a lifting assembly attached to the stanchion, the lift assembly including lifting armatures shaped to accept the watercraft, a lift assembly mass, and a lift assembly center of gravity, the lift assembly positioned to translate vertically along the length of the stanchion;

wherein the trolley mass and the mast device mass combined to establish an unloaded center of mass and the unloaded center of mass is within the trolley footprint; and wherein, when a watercraft is loaded onto the lifting armatures, the watercraft mass, the trolley mass, and the mast device mass combined to establish a loaded center of mass and the loaded center of mass is within the trolley footprint.

16. The stacker crane of claim 15 wherein the stanchion axis is positioned outside the trolley footprint.

17. The stacker crane of claim 15 wherein the trolley mass and the mast device mass combined to establish an unloaded center of rotation and the unloaded center of rotation is within the trolley footprint.

18. The stacker crane of claim 15 wherein, when a watercraft is loaded onto the lifting armatures, the watercraft mass, the trolley mass, and the mast device mass combined to establish a loaded center of rotation and the loaded center of rotation is within the trolley footprint.

19. The stacker crane of claim 18 wherein the loaded center of rotation is approximately along the axis defined by the trolley center of rotation.

20. A stacker crane for movement of watercraft having a watercraft mass and a watercraft center of gravity, the stacker crane used in a watercraft storage facility having storage modules, the stacker crane comprising:

a bridge operatively suspended in the watercraft storage facility, the bridge including a length;

a trolley connected to the bridge, the trolley positioned to translate along the length of the bridge, the trolley including a trolley mass, a trolley center of gravity, a trolley footprint and a rotating turntable positioned to establish a trolley center of rotation;

a mast device connected to the bridge and operatively connected to the trolley, the mast device including a top, a stanchion, a mast device mass and a mass device center of gravity, the top having a first end and a second end, the first end substantially positioned along an axis defined by the trolley center of rotation, the second end attached to the stanchion, the stanchion including a length and having a central axis substantially vertically outside the trolley footprint by a distance approximately equal to the length of the top of the mast device; and a lifting assembly attached to the stanchion, the lift assembly including lifting armatures shaped to accept the watercraft, a lift assembly mass, and a lift assembly center of gravity, the lift assembly positioned to translate vertically along the length of the stanchion;

wherein the trolley mass and the mast device mass combined to establish an unloaded center of rotation and the unloaded center of rotation is within the trolley footprint; and wherein, when a watercraft is loaded onto the lifting armatures, the watercraft mass, the trolley mass, and the mast device mass combined to establish a loaded center of rotation and the loaded center of rotation is within the trolley footprint.

* * * * *